United States Patent [19]

Asari et al.

[11] Patent Number: 4,470,286

[45] Date of Patent: Sep. 11, 1984

[54] UPSETTER MECHANISM FOR SIMULTANEOUSLY UPSETTING A PLURALITY OF WORK ITEMS

[75] Inventors: Akira Asari, Osaka; Fuminori Kaneko; Takashige Yamamura, both of Kobe; Satoshi Matsumoto, Osaka; Takayoshi Dohsai, Hyogo, all of Japan

[73] Assignee: Kabushiki Kaisha Kobe Seiko Sho, Kobe, Japan

[21] Appl. No.: 469,456

[22] Filed: Feb. 24, 1983

[30] Foreign Application Priority Data

Feb. 25, 1982 [JP] Japan ..... 57-30885
Jun. 28, 1982 [JP] Japan ..... 57-112019

[51] Int. Cl.[3] ..... B21D 22/00

[52] U.S. Cl. ..... 72/356; 72/354; 72/453.05

[58] Field of Search ..... 72/354, 356, 453.05, 72/453.06, 453.07

[56] References Cited

U.S. PATENT DOCUMENTS 2,143,429 1/1939 Auble ..... 72/453.07 X
2,305,610 12/1942 Ernst ..... 72/453.06
3,290,919 12/1966 Molinaho et al. ..... 72/453.05
3,311,049 3/1967 Hugi ..... 72/453.05
3,650,142 3/1972 Baldwin ..... 72/453.07

*Primary Examiner*—Leon Gilden
*Attorney, Agent, or Firm*—Oblon, Fisher, Spivak, McClelland & Maier

[57] ABSTRACT

An upsetter mechanism including a die set having a plurality of juxtaposed forming sections, first and second punches extractably protrudable into the respective forming section of the die set, and a punch drive mechanism for driving the punches through a hydraulic cushioning mechanism, the hydraulic cushioning mechanism including a hydraulic cylinder having a maximum diameter corresponding to the total load of the punches; a main pressurizing ram slidably fitted in the hydraulic cylinder; a punch attached to the hydraulic cylinder; and a movable pressurizing ram slidably fitted in a cylinder formed in the hydraulic cylinder of maximum diameter to cope with the load of the first punch and having a second punch attached to the fore end thereof, the movable pressurizing ram being operable independently of the main pressurizing ram.

4 Claims, 43 Drawing Figures

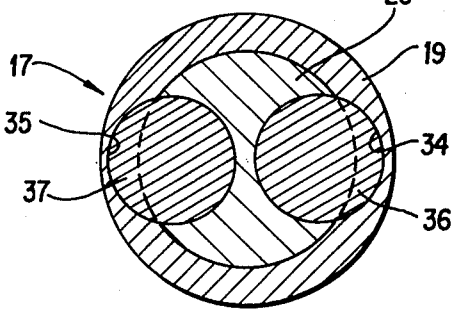
FIG. 5(b)
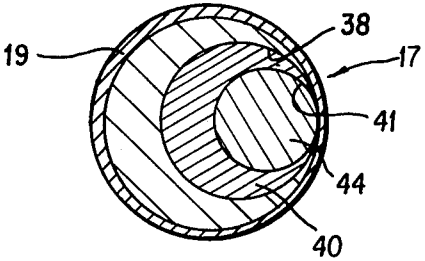
FIG. 6(b)
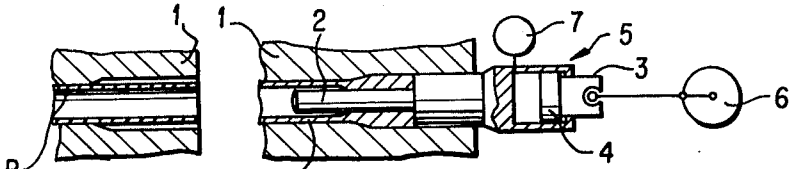
FIG. 1(a) PRIOR ART
FIG. 1(b) PRIOR ART
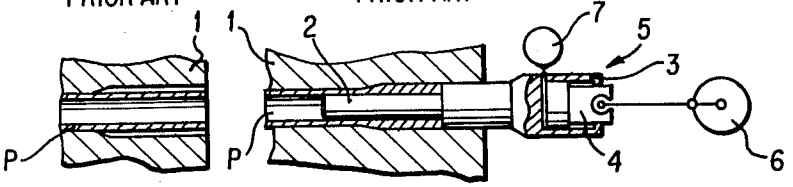
FIG. 2(a) PRIOR ART
FIG. 2(b) PRIOR ART
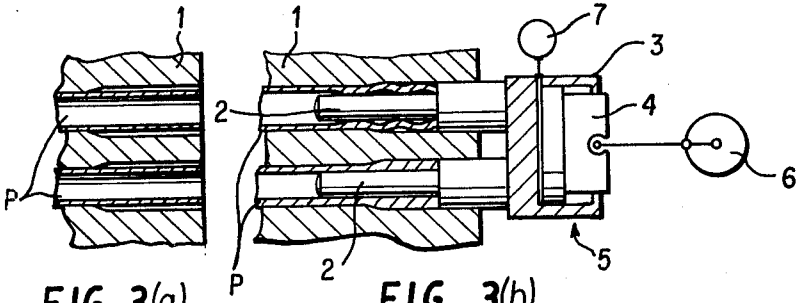
FIG. 3(a) PRIOR ART
FIG. 3(b) PRIOR ART

UPSETTER MECHANISM FOR SIMULTANEOUSLY UPSETTING A PLURALITY OF WORK ITEMS

BACKGROUND OF THE INVENTION

1. Field of the Invention

This invention relates to an upsetter for simultaneously upsetting a plurality of items or work pieces, and more particularly, to an upsetter which is capable of simultaneously upsetting a desired number of work items in spite of the existence of variations in volume between the individual work items to improve its productivity to a significant degree.

2. Description of the Prior Art

It is known in the art to employ an upsetter which is provided with a hydraulic cushioning mechanism to cope with variations in the volume of work items to be upset, as illustrated in FIGS. 1*a* to 3*b*. More specifically, in FIGS. 1*a* to 3*b* denoted at 1 is a split die set with a forming section, and at 2 a punch which is extractably protrudable into the forming section of the die set and which is, in the particular example shown, driven by a crank type punch drive mechanism 6 through a hydraulic cushioning mechanism 5 constituted by a hydraulic cylinder 3 and a pressurizing ram 4 fitted fluid-tightly in the cylinder 3. Reference numeral 7 indicates a pressure accumulator.

FIGS. 1*a* and 1*b* illustrate an upsetting operation of a single thin-walled pipe P, while FIGS. 2*a* and 2*b* an upsetting operation of a single thick-walled pipe P. Obviously, the operational efficiency or the productivity is lowered when work items of different volumes are upset separately in this manner.

In order to eliminate this difficulty, there has been proposed an upsetter as shown in FIGS. 3*a* and 3*b*, which is provided with a number of forming sections side by side in the split die set 1 and a corresponding number of punches 2 which are extractably protrudable into the respective forming sections for upsetting simultaneously a plurality of work items.

The upsetter of FIGS. 3 is capable of multiple upsetting operation as long as there is no difference in volume between the work items which simultaneously undergo the upsetting operation. However, simultaneous upsetting operation becomes difficult when there is a difference in volume as seen in FIG. 3*b*.

SUMMARY OF THE INVENTION

With the foregoing in view, the present invention has as its object the provision of an upsetter which can upset a plurality of work items simultaneously in spite of variations in volume of the upsetting work items by the use of an improved hydraulic cushioning mechanism.

It is a more specific object of the present invention to provide improvements in the hydraulic cushioning mechanism for an upsetter, which permits multiple upsetting operations as well as progressive multiple upsetting operations in an efficient and simplified manner.

It is another object of the present invention to provide a hydraulic cushioning mechanism for an upsetter, employing a hydraulic cylinder unit replaceably mounted on the upsetter and calibrated to press the upsetting punches in a predetermined power ratio.

It is still another object of the present invention to provide a hydraulic cushioning mechanism for an upsetter, employing a reversing mechanism for rotating the hydraulic cylinder unit into a reversed position relative to the die set mounted on the upsetter.

According to one aspect of the present invention, there is provided an upsetter with an upsetting mechanism including a die set having a plurality of juxtaposed forming sections, a plurality of punches extractably protrudable into the respective forming section of the die set, and a punch drive mechanism for driving the punches through a hydraulic cushioning mechanism, the hydraulic cushioning mechanism comprising a hydraulic cylinder having a maximum diameter corresponding to the total load of the punches; a main pressurizing ram slidably fitted in the hydraulic cylinder; a punch attached to the hydraulic cylinder; and a movable pressurizing ram slidably fitted in a cylinder formed in the hydraulic cylinder of the maximum diameter to cope with the load of at least one punch and having a punch attached to the fore end thereof, the movable pressurizing ram being operable independently of the main pressurizing ram.

In a preferred form of the invention, the punch which is attached to the movable pressurizing ram is adapted to be advanced in the upsetting direction prior to the punch which is attached to the hydraulic cylinder.

The above and other objects, features and advantages of the present invention will become apparent from the following description and appended claims, taken in conjunction with the accompanying drawings which show by way of example some preferred embodiments of the invention.

BRIEF DESCRIPTION OF THE DRAWINGS

In the accompanying drawings:

FIGS. 1*a*, 1*b*, 2*a*, 2*b*, 3*a* and 3*b* are schematic illustrations of conventional upsetters with a hydraulic cushioning mechanism;

FIGS. 4*a* to 4*g* show a first embodiment of the present invention and its operation, of which FIG. 4*a* is a sectional view of its major components, FIG. 4*b* is a sectional view taken on line A—A of FIG. 4*a*, FIG. 4*c* and 4*d* and FIGS. 4*e* and 4*f* are schematic illustrations of a simultaneous upsetting operation of a thin-walled work item and a thick-walled work item, and FIG. 4*g* is a schematic illustration of an operation for forging the work item into a final shape by progressive two-stage upsetting;

FIGS. 5*a L and* 5*b* show a second embodiment of the present invention, of which FIG. 5*a* is a schematic sectional view of its major components, and FIG. 5*b* is a sectional view taken in the direction of arrow B—B of FIG. 5*a;*

FIGS. 6*a* and 6*b* show a third embodiment of the present invention, of which FIG. 6*a* is a schematic sectional view of its major components, and FIG. 6*b* is a sectional view taken in the direction of arrow C—C of FIG. 6*a;*

FIGS. 7*a* to 7*h* show in greater detail the construction of the second embodiment, of which FIGS. 7*a* and 7*b* are sectioned front views of die opening and closing stages, respectively, FIG. 7*c* is a sectional view taken on line E—E of FIG. 7*b*, FIG. 7*d* is a sectional view taken on line D—D of FIG. 7*a*, and FIGS. 7*e* to 7*h* are views similar to FIG. 7*d* but showing different operational stages;

FIGS. 11*a* to 11*c* show still another embodiment of the invention, of which FIG. 11*a* is a longitudinal section showing major components, FIG. 11*b* is a cross-section of a cylinder unit in reversed position, and FIG. 11*c* is a sectional view taken on line C—C of FIG. 11*a;*

DETAILED DESCRIPTION OF PREFERRED EMBODIMENTS

Figure 4B:
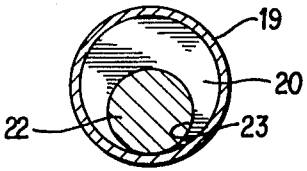

Referring to FIGS. 4*a* to 4*g* which illustrate the construction and operation of the first embodiment of the present invention, designated at 10 is a split die set which is provided with side by side a plurality of forming sections in the opposing faces, e.g., a couple of forming sections 11 and 12 in the particular embodiment shown. Reference numerals 13 and 14 denote punches which are detachably fixed in holders 15 and 16, respectively, by threaded engagement or by other suitable means, and extractably protrudable into the opposing forming sections 11 and 12 of the die.

The upsetter is provided with a hydraulic cushioning mechanism 17 which is constituted by a hydraulic cylinder 19 communicating with a pressure accumulator 18 and having a maximum diameter corresponding to the total load of the punches, and a main pressurizing ram 20 slidably and fluid-tightly fitted in the hydraulic cylinder 19. One of the punches 13 and 14 is attached to the hydraulic cylinder 19, while the other is attached to another pressurizing ram 22.

More specifically, a cylinder 23 with a sectional area corresponding to $\frac{1}{3}$ the area of the sectional area of the hydraulic cylinder 19 (i.e., the pressurizing area of the ram 20) is formed in the hydraulic cylinder 19, fitting in the cylinder 23 a movable pressurizing ram 22 which is operable independently of the ram 20. A punch 14 which is attached to the movable pressurizing ram 22 is protrudable in the upsetting direction always prior to the punch 13 which is attached to the hydraulic cylinder 19.

Now, the operation of the first embodiment is explained with reference to FIGS. 4*a* to 4*g*.

Figure 4A:
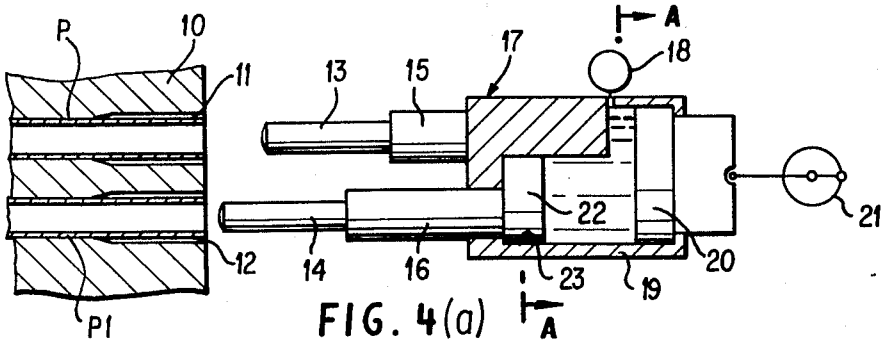

FIG. 4*a* shows a stage where a couple of pipes or similar work items P and $P_1$ to be upset are inserted in the forming sections 11 and 12 of the split die 10, blocking axial movement of the pipes P and $P_1$ by a gripping mechanism (not shown). Then, a punch drive mechanism 21 is actuated in the upsetting direction, whereupon the fluid pressure (e.g., oil pressure) in the hydraulic cylinder 19 is compressed by advancement of the pressurizing ram 20 to support a force corresponding to the total load of the punches.

Figure 4D:
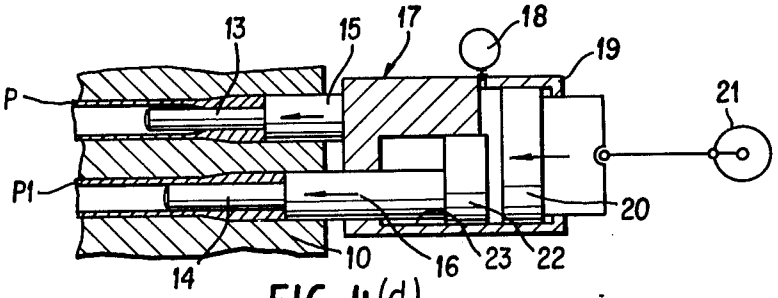
Figure 4C:
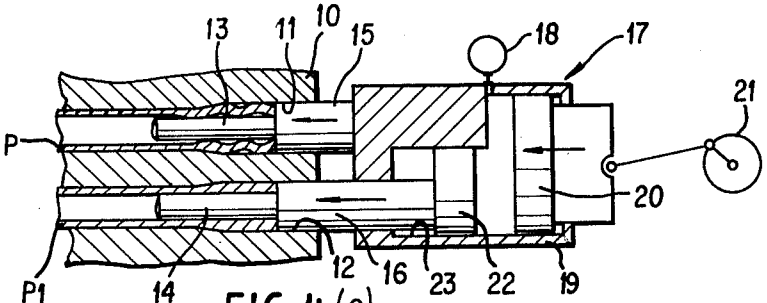
Figure 4F:
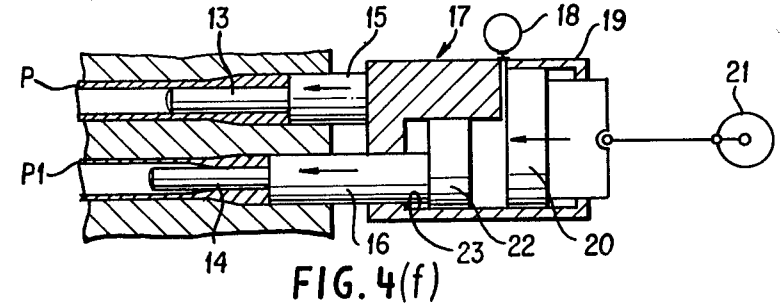
Figure 4E:
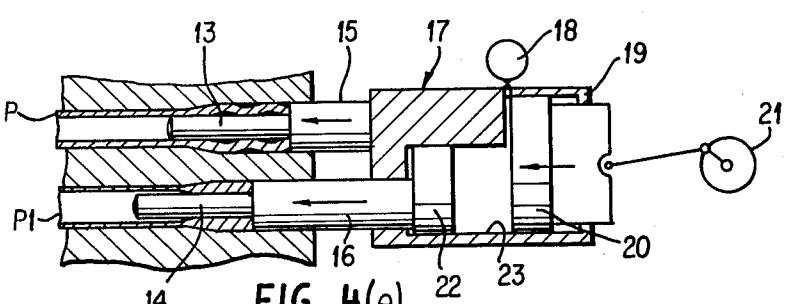

In this instance, as the movable pressurizing ram 22 is independently operably fitted in the cylinder portion 23 in the hydraulic cylinder 19, the punch 14 is first advanced in the upsetting direction by the movable pressurizing ram 22 to upset the thick-walled pipe $P_1$ in the initial phase in the case of FIG. 4*c* and the thin-walled pipe $P_1$ in the case of FIG. 4*e*.

Namely, in the present embodiment, a preceding punch is first driven in the middle of the full stroke of the crank type punch drive mechanism 21 to upset one pipe, and the thin- and thick-walled pipes $P_1$ P are both upset at the ends of the full strokes of the respective punches as shown in FIGS. 4*d* and 4*f*, permitting the simultaneous upsetting of the two pipes in spite of the difference in volume if any.

Figures 4G, 5A, 6A:
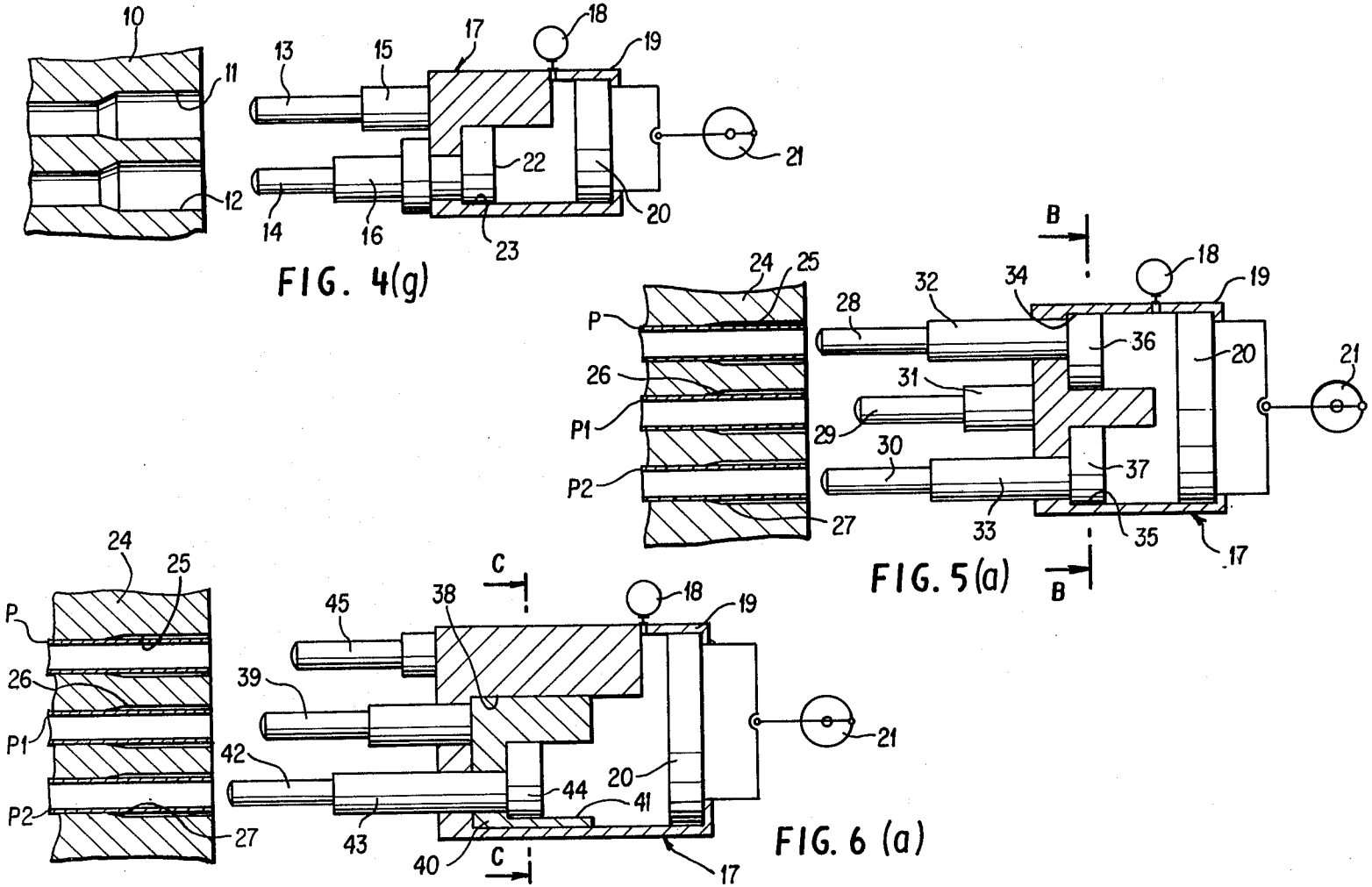
Figure 7A:
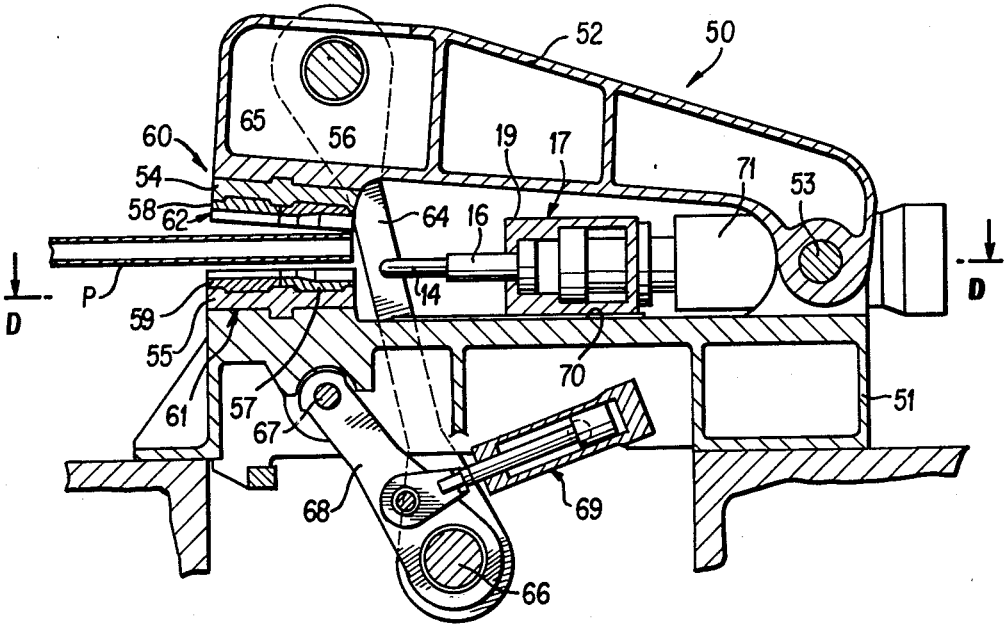
Figure 7B:
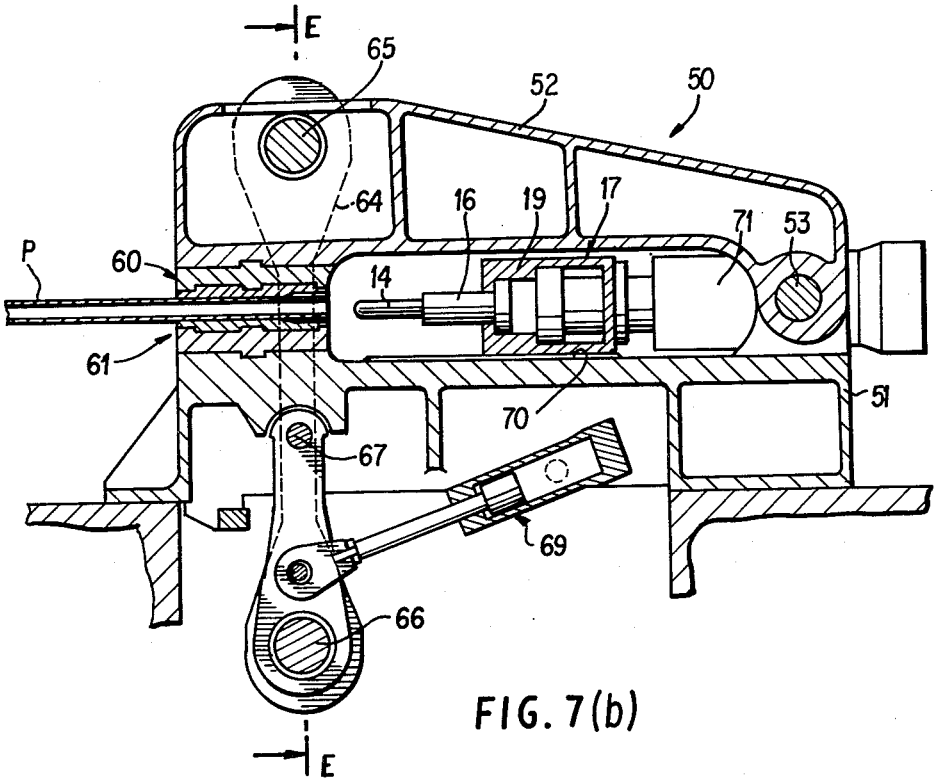
Figure 7D:
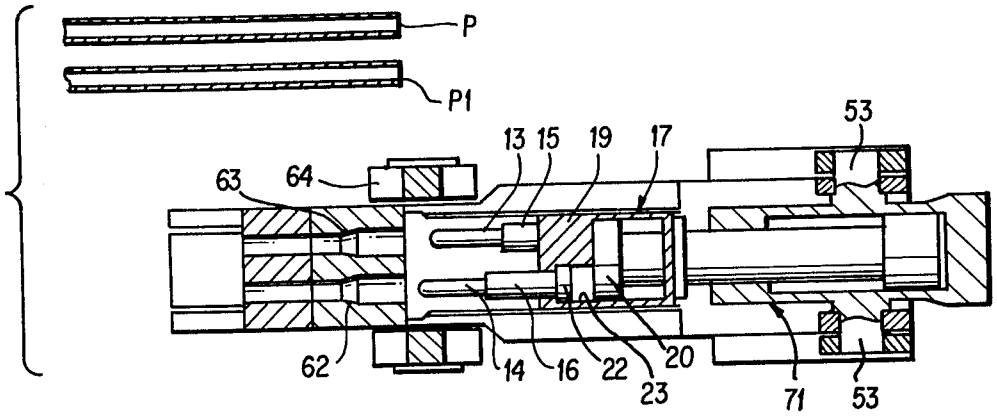
Figure 7E:
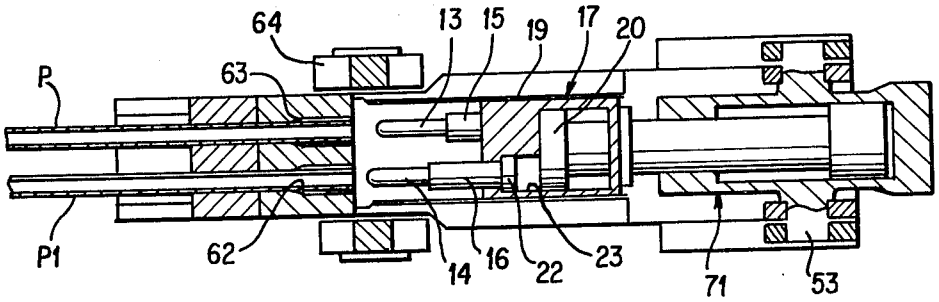
Figure 7C:
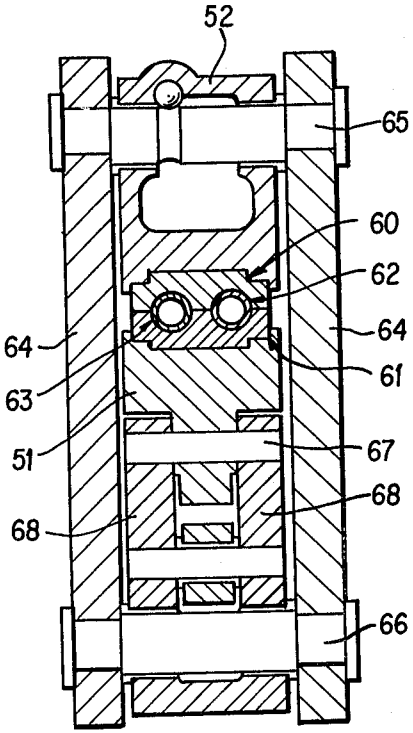
Figure 7F:
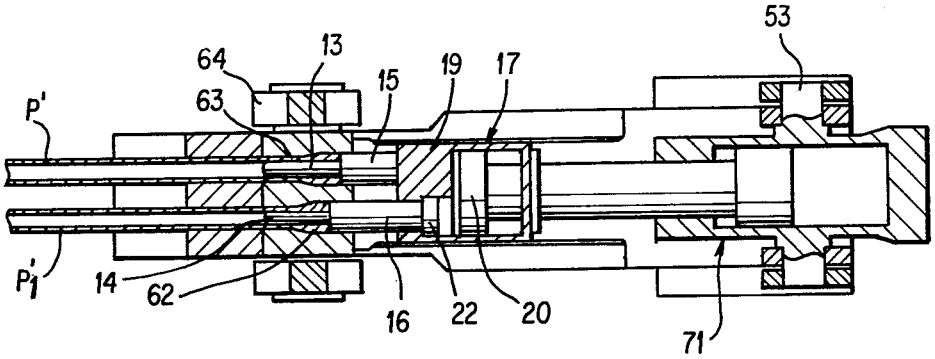
Figure 7G:
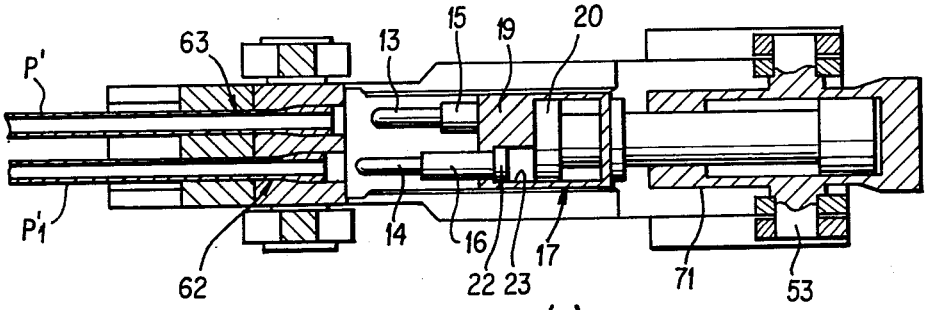
Figure 7H:
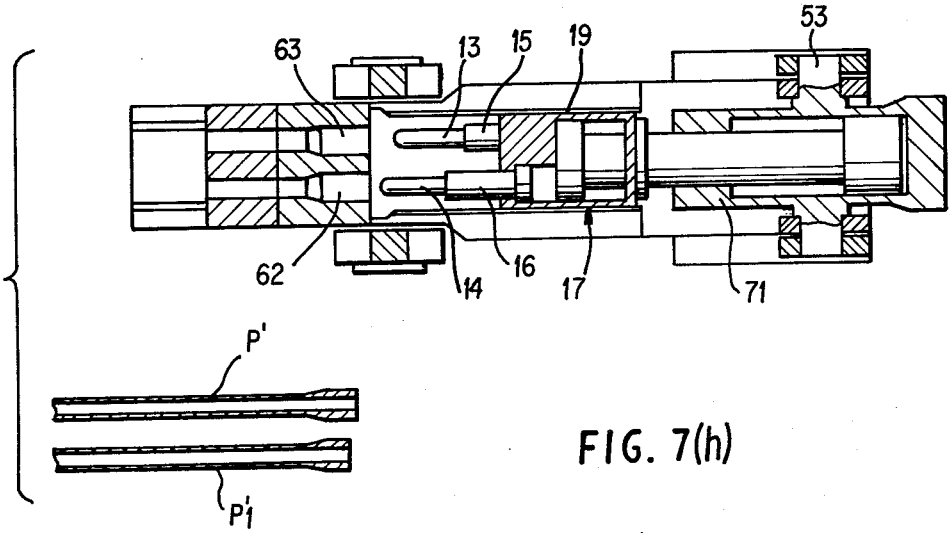

Upon completion of upsetting, the punches 13 and 14 are withdrawn from the forming sections 11 and 12 by the punch drive mechanism 21 through the hydraulic cushioning mechanism 17 before opening the die 10, as shown in FIG. 4*g*. In the case of work items which require more than one pressurization to complete the forming operation, it is possible to upset the work items progressively through a number of stages in the usual manner by providing a fixed member 19A between the rear end of the punch 14 opposing the movable ram 22 and the hydraulic cylinder 19 as shown in FIG. 4*g*.

Referring now to FIGS. 5*a* and 5*b*, there is shown the second embodiment of the present invention, which is arranged to simultaneously upset three pipes and in which the split die 24 is provided with three juxtaposed forming sections 25 to 27. Of the three punches 28 to 30 which are extractably protrudable into the forming sections 25 to 27, the middle punch 29 is securely fixed to the center of the hydraulic cylinder 19 through a holder 31 while the outer punches 28 and 30 are securely fixed through holders 32 and 33 to independently movable pressurizing rams 36 and 37 which are fitted in subcylinders 34 and 35 formed in the hydraulic cylinder 19, respectively. Upon driving forward the pressurizing ram 20 by the punch drive mechanism 21, the outer punches 28 and 30 are advanced in the upsetting direction prior to the intermediate punch 29.

FIGS. 6*a* and 6*b* shows the third embodiment which is arranged to upset three pipes simultaneously similarly to the above-described second embodiment. In this embodiment, the hydraulic cylinder 19 is provided with a second cylinder 38 which is $\frac{2}{3}$ of the cylinder 19 in sectional area, and a movable pressurizing ram 40 which is connected to the center punch 39 is fitted in the subcylinder 38. Formed in the movable ram 40 is a third cylinder 41 which has a sectional area that is one-half of the movable ram 40 and slidably receives therein a second movable ram 44 which is connected to the lower punch 42 through a holder 42. The upper punch 45 is securely fixed to the cylinder 19 with a maximum diameter corresponding to the total load of the punches.

In the embodiment shown in FIGS. 6*a* and 6*b*, as the pressurizing ram 20 is driven forward by the punch drive mechanism 21, the lower punch 42 is advanced in the upsetting direction in the first place, the middle punch 39 is independently advanced in the upsetting direction, and finally the upper punch 45 is advanced in the upsetting direction. Even if there are variations in volume between the respective work items P, $P_1$ and $P_2$, they can be upset simultaneously in both of the second and third embodiments.

In FIGS. 5(*a*), (*b*) and 6(*a*), (*b*), common component parts are designated by like reference numerals, and indicated at 18 is a pressure accumulator.

FIGS. 7*a* to 7*h* show in greater detail the first embodiment of the present invention as applied to an upsetter 50, wherein the reference numerals 51 and 52 denote a base and a tong which are pivotally connected by a transverse shaft 53 for opening and closing the tong 52 relative to the base 51.

Mounted on the opposing sides of the base 51 and tong 52 are split dies 60 and 61 including upper and lower die holders 54 and 55, upper and lower upset dies 56 and 57, and upper and lower clamp dies 58 and 59. In the particular example shown, the split dies 60 and 61 are provided with a couple of juxtaposed forming sections 62 and 63.

Designated at 64 is a pair of gripping pull rods which are pivotally connected to the tong head in their upper portions through a fulcrum shaft 65 and to a grip ring 68 in their lower portions through a fulcrum shaft 65 and to a grip ring 68 in their lower portions through a fulcrum shaft 66. The grip ring 68 which is pivotally connected to the bed head through a pin 67 supports thereon a grip have mechanism 69 which is in the form of a piston-cylinder in the particular example shown.

The punches 13 and 14 of the first embodiment are located on a slide surface 70 on the upper side of the bed 51 along with the hydraulic cylinder mechanism 17, through a punch drive mechanism 71 which is constituted by a piston-cylinder in the particular example shown.

Referring to FIGS. 7, a couple of work items P and $P_1$ are loaded into the split dies 60 and 61 in the stage of FIG. *7a* by the operation of a transfer mechanism (not shown), and then the grip drive mechanism 69 is extended to apply a required die closing force on the split dies 60 and 61 as shown in FIG. *7b*.

In the next stage, the punch drive mechanism 71 is extended to slide forward the hydraulic cushioning mechanism 17 along the slide surface 70, whereupon the movable ram 22 which is independently operably mounted in the hydraulic cylinder 19 is first pushed forward to upset the head portion of the work item $P_1$ with the punch 15 and then the punch 13 which is attached to the hydraulic cylinder 19 is driven to upset the head portion of the other work item P.

Accordingly, the two work items P and $P_1$ can be simultaneously upset even if there is a difference in volume between the two work items, as shown particularly in FIGS. *7f* and *7g*. Of course, the simultaneous upsetting operation is possible when there is no difference in volume of the work items.

Figure 8:
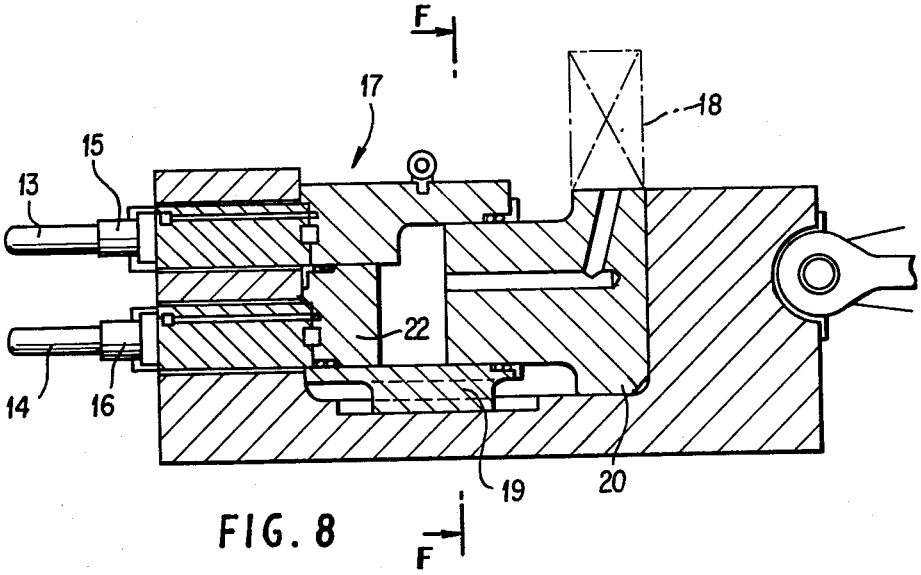
FIG. 8 is a sectional view of major components in a fundamental embodiment of the invention.
Figure 9:
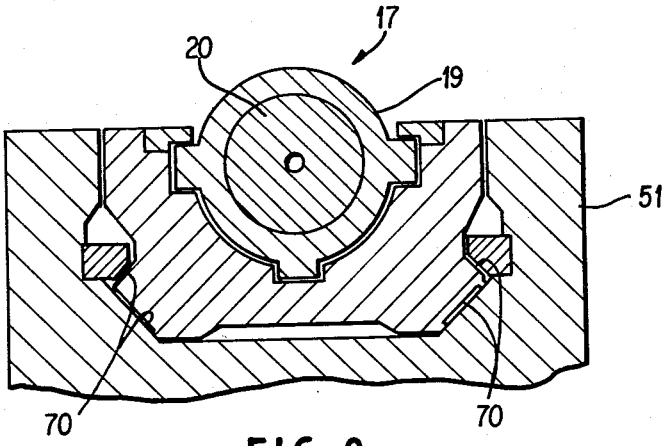
FIG. 9 is a sectional view taken on line F—F of FIG. 8.

After upsetting the head portions in this manner, the punch drive mechanism 71 is contracted to retract the punches and then the grip drive mechanism 69 is contracted in the example shown, releasing the split dies 60 and 61 to eject the products P' and $P_1'$ as shown in FIG. *7h* by the operation of a transfer mechanism which is not shown. FIGS. 8 and 9 illustrate a fundamental embodiment of the invention, wherein the punch 14 attached to the movable pressurizing ram 22 is moved along with the punch 13 attached to the cylinder 19 and in which the component parts common to the first embodiment are designated by like reference numerals.

Figure 10A:
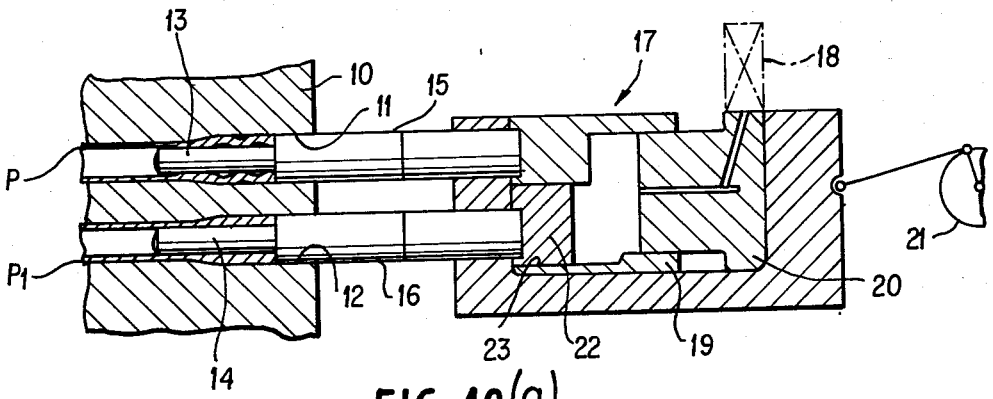
FIG. 10*a* to 10*f* are sectional views showing sequential phases of operation.
Figure 10B:
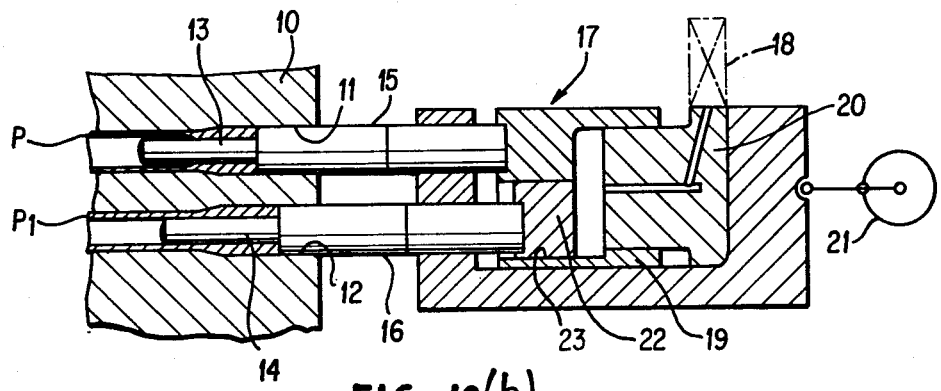
Figure 10C:
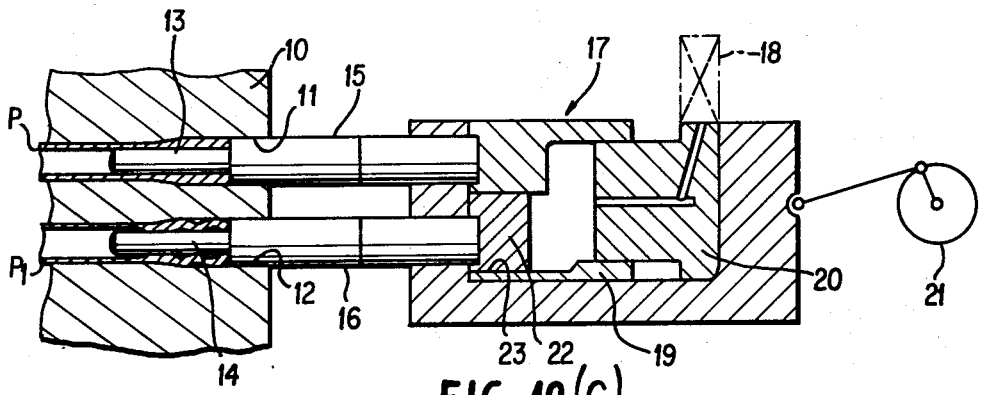
Figure 10D:
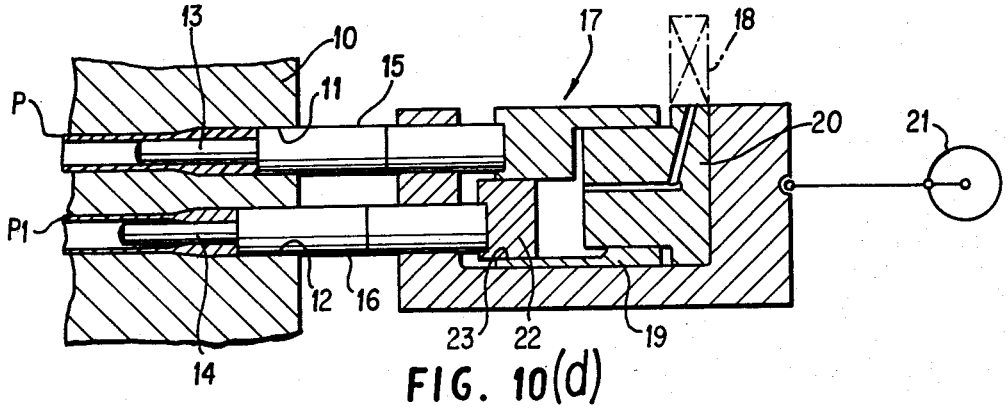

In the embodiment of FIGS. 8 and 9, the punches 13 and 14 are moved together in the upsetting direction as shown in FIGS. 10*a* and 10*b*, and, after completing upsetting of a thick-walled product $P_1'$ as shown in FIG. 10*a*, the upsetting of a thin-walled product P' is finished as shown in FIG. 10*b*. Even when the thick- and thin-walled products P' and $P_1'$ are loaded in positions reverse to FIGS. 10*a* and 10*b* as shown in FIGS. 10*c* and 10*d*, a plurality of work items can be upset simultaneously in a similar manner.

Figure 10E:
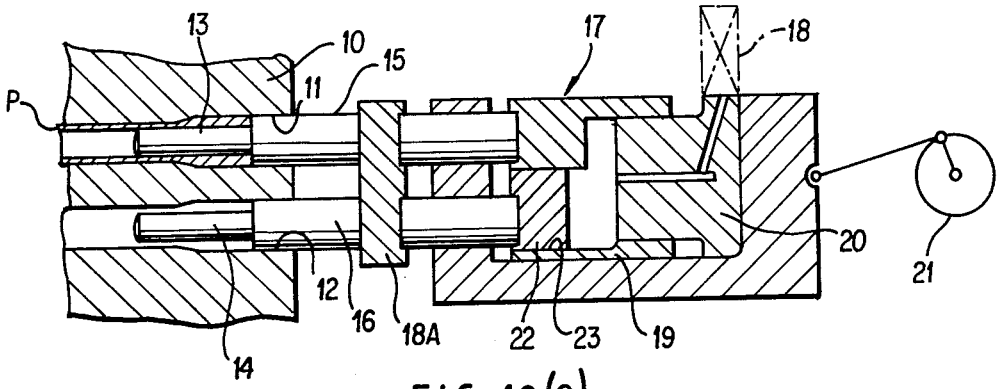
Figure 10F:
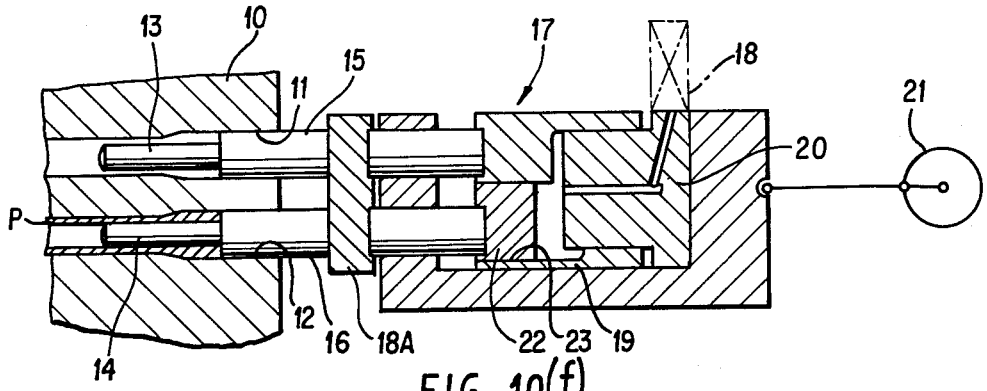

In a case where the upsetter is used for two-stage progressive upsetting as shown in FIGS. 10*e* and 10*f*, namely, in a case where the operation requires almost a doubled upsetting force or is difficult to upset in a single step, it is first subjected to upsetting of the first stage (by applying to the punch the combined force of the movable ram 22 and the hydraulic cylinder 19 through the fixed member 19A) as shown in FIG. 10*e* and then subjected to upsetting of the second stage by the pressurizing ram 20 as shown in FIG. 10*f*.

Thus, according to the present invention, the upsetter is provided with hydraulic pressurizing means opposingly to one or more than one punch load within and independently of the hydraulic cylinder with the maximum diameter corresponding to the total punch load, so that it can be applied either to simultaneous upsetting of a plurality of work items or to upsetting by a doubled force. Further, a punch attached to a movable ram, which is fitted in the hydraulic cylinder, is advanced in the upsetting direction prior to a punch which is attached to the hydraulic cylinder, permitting upsetting of a plurality of work items simultaneously irrespective of differences in volume of the work items and therefore improving productivity to a considerable degree.

The upsetter of the present invention, with an improved hydraulic cushioning mechanism is suitable for upsetting head portions of elongated work items as well as from upsetting oil well pipes.

Referring now to FIGS. 12*a* to 12*e*, there are shown examples of hydraulic cylinder units with movable rams 117 of different sectional areas relative to the hydraulic cylinder 110 of the maximum diameter, providing different power ratios of the first to second stage, namely, the power ratios of 1:3 (FIG. 12*a* ), 1:2 (FIG. 12*b*), 1:1 (FIG. 12*c*), 1:0.5 (FIG. 12*d*) and 1:1/3 (FIG. 1-*e*). The cylinder unit is replaceably mounted on a slide 109 of the upsetter. In order to permit easy replacement of the cylinder unit, the punch holders 106 and 107 are also detachably mounted on the upsetter.

Figure 11A:
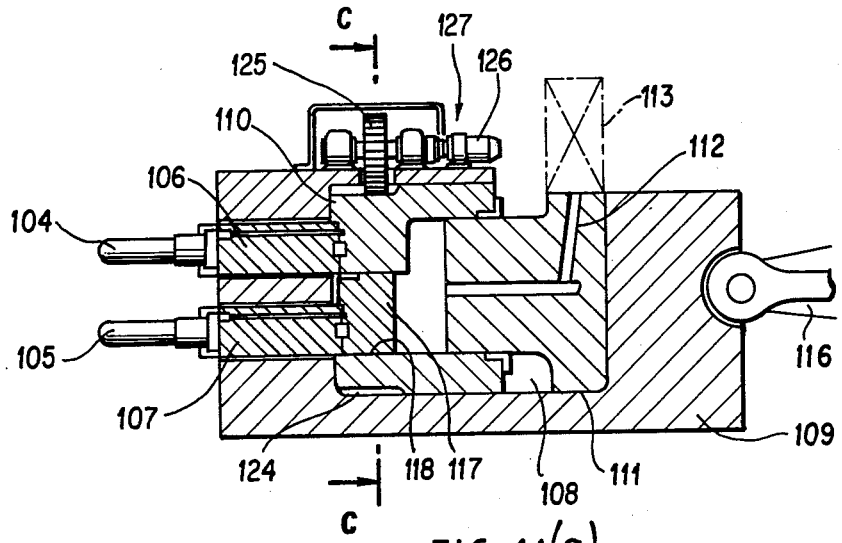
Figure 11B:
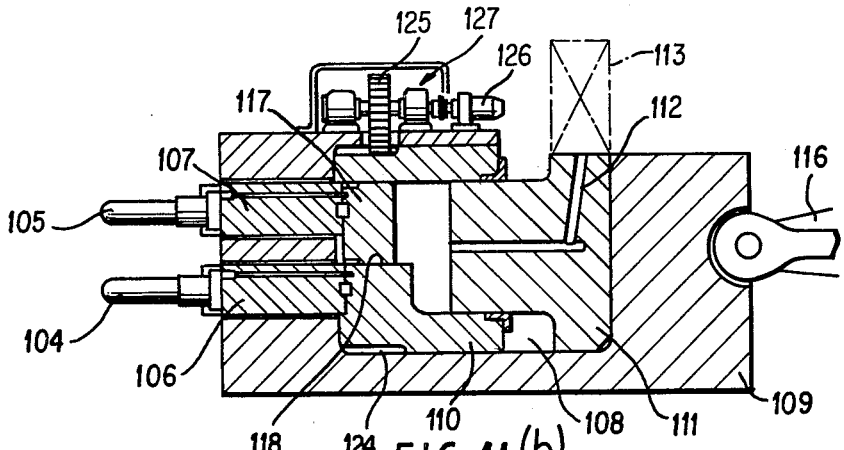
Figure 12A:
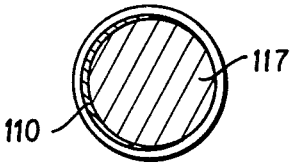
FIGS. 12*a* to 12*e* are schematic views showing some examples of the cylinder unit.
Figure 12B:
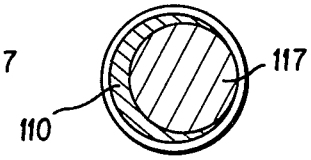
Figure 12C:
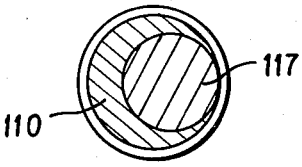
Figure 12D:
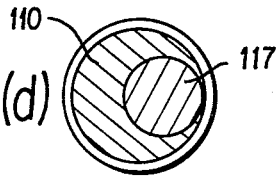
Figure 12E:
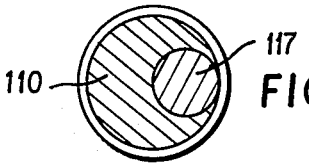
Figure 11C:
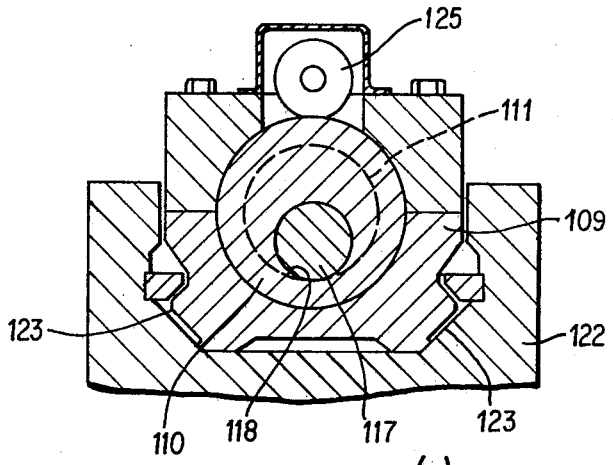

FIG. 11*a* to 11*c* show a further useful embodiment of the present invention employing the replaceable cylinder unit, in which a cylinder unit 110 is fitted in a split type slide 109 through a shoe guide 123, holding the cylinder 110 rotatably about its axis. In this case, the hydraulic cylinder 110 is associated with a reversing mechanism 127 for rotating the cylinder 110 about its axis, the reversing mechanism including a gear 124 formed on the outer periphery of the cylinder 110, and a drive gear 125 meshed with the gear 124 and driven from a motor 126 or the like.

Figure 13A:
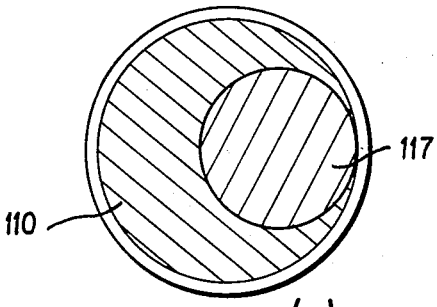
FIGS. 13*a* and 13*b* are schematic sectional views showing the cylinder unit of FIGS. 11.
Figure 13B:
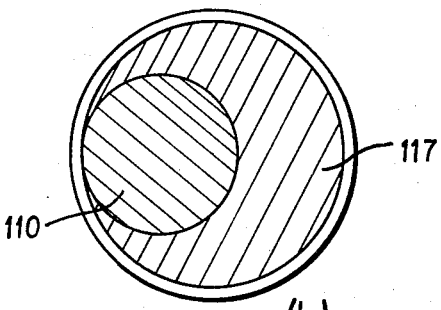

In the embodiment of FIGS. 11, the hydraulic cylinder 110 is reversed about its axis upon actuating the motor 126 through the intermeshed gears 125 and 124 to cope with the required upsetting force in the first or second stage. Examples of the reversible hydraulic cylinder construction are shown in FIGS. 13*a* and 13*b*.

The foregoing embodiment which permits replacement of the hydraulic cylinder as a unit of a required power ratio is particularly suitable for application to those products which need hot forging through a plurality of stages, forging the work items by the use of a hydraulic cylinder of a power ratio conforming with the load requirements in the respective forging stages. Further, it becomes possible to provide a machine of compact construction and to reduce the energy consumption, coupled with the advantages that the precision of the production products and the service life of the die are improved by prevention of application of unnecessarily large loads on the work items.

Moreover, the upsetter which is capable of simultaneously multi-stage or progressive upsetting can improve the productivity to a significant degree. In the case of the embodiment employing the reversing mechanism which can reverse the position of the hydraulic cylinder through rotation about its axis, the power ratio of the first to second stage can be reversed, if necessary, without replacing the cylinder unit. This is very advantageous from the standpoint of operationability in addition to a marked improvement in productivity.

Obviously, numerous modifications and variations of the present invention are possible in light of the above teachings. It is therefore to be understood that within the scope of the appended claims, the invention may be practiced otherwise than as specifically described herein.

What is claimed as new and desired to be covered by Letters Patent of the United States is:

1. An upsetter mechanism comprising;

a die set having a plurality of juxtaposed forming sections;

a first and second punch extractably protrudable into respective forming sections of said die set; and a punch drive mechanism for driving said punches via a hydraulic cushioning mechanism wherein said hydraulic cushioning mechanism further comprises:

a hydraulic cylinder having a maximum diameter corresponding to a total load of said punches and having a smaller diameter cylinder formed therein;

a main pressurizing ram slidably positioned in said hydraulic cylinder, said first punch being attached to said hydraulic cylinder; and a movable pressurizing ram positioned in said smaller cylinder formed in said hydraulic cylinder having a maximum diameter for coping with the load of said first punch and having said second punch attached to the fore end of said ram, said movable pressurizing ram being operable independently of said main pressurizing ram.

2. An upsetter as set forth in claim 1, wherein said second punch of said movable pressurizing ram is protrudable in an upsetting direction prior to said first punch attached to said hydraulic cylinder.

3. An upsetter as set forth in claim 1, wherein said hydraulic cylinder of maximum diameter further comprises a unit having a plurality of upsetting stages of a predetermined power ratio and which are replaceably mounted on said upsetter.

4. An upsetter as set forth in claims 1 2, or 3, further comprising reversing means for fixably rotating said hydraulic cylinder about the axis thereof to reverse the position of said hydraulic cylinder relative to said die set.

* * * * *